US006068364A

United States Patent [19]

Kusumi et al.

[11] Patent Number: 6,068,364

[45] Date of Patent: May 30, 2000

[54] CAP FOR SERVICE STATION FOR INK-JET PRINTHEADS

[75] Inventors: Tatsuya Kusumi; Koichi Tanaka, both of Niigata, Japan

[73] Assignee: NEC Corporation, Japan

[21] Appl. No.: 08/971,480

[22] Filed: Nov. 15, 1997

[30] Foreign Application Priority Data

Nov. 20, 1996 [JP] Japan ..... 8-308568

[51] Int. Cl.[7] ..... B41J 2/165

[52] U.S. Cl. ..... 347/29

[58] Field of Search ..... 347/22, 29, 30, 347/86, 87

[56] References Cited

U.S. PATENT DOCUMENTS

| | | | |
|---|---|---|---|
| 4,853,717 | 8/1989 | Harmon et al. | 347/29 |
| 5,027,134 | 6/1991 | Harmon et al. | 347/29 |
| 5,146,243 | 9/1992 | English et al. | 347/29 |
| 5,210,550 | 5/1993 | Fisher et al. | 347/30 |
| 5,216,449 | 6/1993 | English | 347/29 |
| 5,426,456 | 6/1995 | Kuelzer et al. | 347/30 |
| 5,448,270 | 9/1995 | Osborne | 347/29 |
| 5,504,508 | 4/1996 | Hashimoto | 347/24 |
| 5,717,444 | 2/1998 | Sugimoto et al. | 347/29 |

FOREIGN PATENT DOCUMENTS

| | | |
|---|---|---|
| 0452119 | 10/1991 | European Pat. Off. . |
| 59-45161 | 3/1984 | Japan . |
| 3-213351 | 9/1991 | Japan . |
| 6-336029 | 12/1994 | Japan . |

*Primary Examiner*—N. Le
*Assistant Examiner*—Anh T. N. Vo
*Attorney, Agent, or Firm*—Ostrolenk, Faber, Gerb & Soffen, LLP

[57] ABSTRACT

An ink jet printer comprises a cap having a shape that defines a cavity around the printhead, a cap body formed with a lip region and a beam extending across the cavity, and a basin structure formed with a vent for providing an exit passage from the cavity through a vent port. The cap body and the basin structure cooperate to define a capillary space to create an effective seal between the cavity and the vent associated therewith.

6 Claims, 4 Drawing Sheets

CAP FOR SERVICE STATION FOR INK-JET PRINTHEADS

BACKGROUND OF THE INVENTION

1. Field of the Invention

The present invention relates to ink-jet printers and, more particularly to a cap for a service station for servicing ink-jet printheads.

2. Description of the Related Art

Ink-jet printers print by shooting drops of ink onto a page. The ink is stored in a reservoir and discharged onto the page through nozzles in a printhead. To print an image, the printhead moves back and forth across the page shooting drops as it moves.

A problem with ink-jet printers is that air bubbles may be forced into the nozzles to interfere with the operation of the printhead. Additionally, ink may drool out of the nozzles, dry and clog them. Debris such as dirt and paper dust may also collect on the printhead and clog the nozzles.

To address these problems, ink-jet printers typically include caps and service stations. A cap encloses and defines a cavity around the printhead when the printhead is not in use or needs servicing. A service station is a location on the printer where the printhead can be serviced. The cap is usually located in the service station.

The cap helps prevent ink from drying on the printhead by providing a cavity that is kept moist. Ink is discharged into the cavity and the moisture from the ink keeps it from drying on the printhead.

However, the volume of the cavity is decreased when the cap encloses the printhead, resulting in a change of pressure within the cavity. If the pressure within the cavity changes, air bubbles are forced into the nozzles of the printhead. Thus, the caps are vented to allow the pressure within the cavity to equalize with the pressure outside the cavity so that air bubbles are not forced into the nozzle of the printhead.

Previously, caps have been vented through a pump connected to the cavity. An example of such a cap is disclosed in U.S. Pat. No. 4,853,717 entitled "Service Station for Ink-Jet Printer."

When an ink-jet printer is turned on, a control algorithm causes the printhead to fire ink through all the nozzles into the cap to clean the nozzles and remove any plugs of ink. The nozzles may also be fired at selected times during printing. The drops of ink that are fired keep the cavity defined by the cap moist or in a humid environment so that ink will not dry on the printhead when it is not in use.

Commonly, an elastic cap is placed over the nozzle end of a printhead to ensure a sufficiently humid environment. Such a cap must form a leak-free seal between the printhead nozzles and the ambient environment. Forcing the cap onto the printhead with enough force to deform the cap around its sealing lip accomplishes this leak-free seal. An example of such an elastic cap is disclosed in U.S. Pat. No. 5,448,270 entitled "Ink-Jet Printhead Cap Having Suspended Lip."

A problem with ink-jet printhead caps is that the humid environment within a cavity around the nozzles may be comprised through vents that open directly to the cavity.

To address this problem, the vents may be covered with an absorbent pad to create an effective seal while insuring venting to the ambient environment, thereby preventing the cavity from being dried.

An object of the present invention is to provide an effective seal between the cavity defined by a cap and the ambient environment without any absorbent pad.

SUMMARY OF THE INVENTION

According to one aspect of the present invention, a cap defines a cavity around a printhead and a capillary space to create an effective seal between the cavity and a vent associated with the cavity.

According to a specific aspect of the present invention, there is provided an ink-jet printer comprising:

a printhead;

a cap that defines a cavity around said printhead;

a vent associated with said cavity; and walls associated with said cavity to define a capillary space to create an effective seal between said cavity and said vent.

According to a further specific aspect of the present invention, there is provided a cap for an ink-jet printhead, comprising:

a cap body; and a basin structure having mounted thereon said cap body, said cap body and said basin structure cooperating with each other to define a cavity around the printhead, said basin structure including a frame member and a vent port within said frame member;

said cap body and said frame member defining therebetween a capillary space around said vent port to create an effective seal between said vent port and said cavity.

DESCRIPTION OF THE EMBODIMENT

Figure 1:
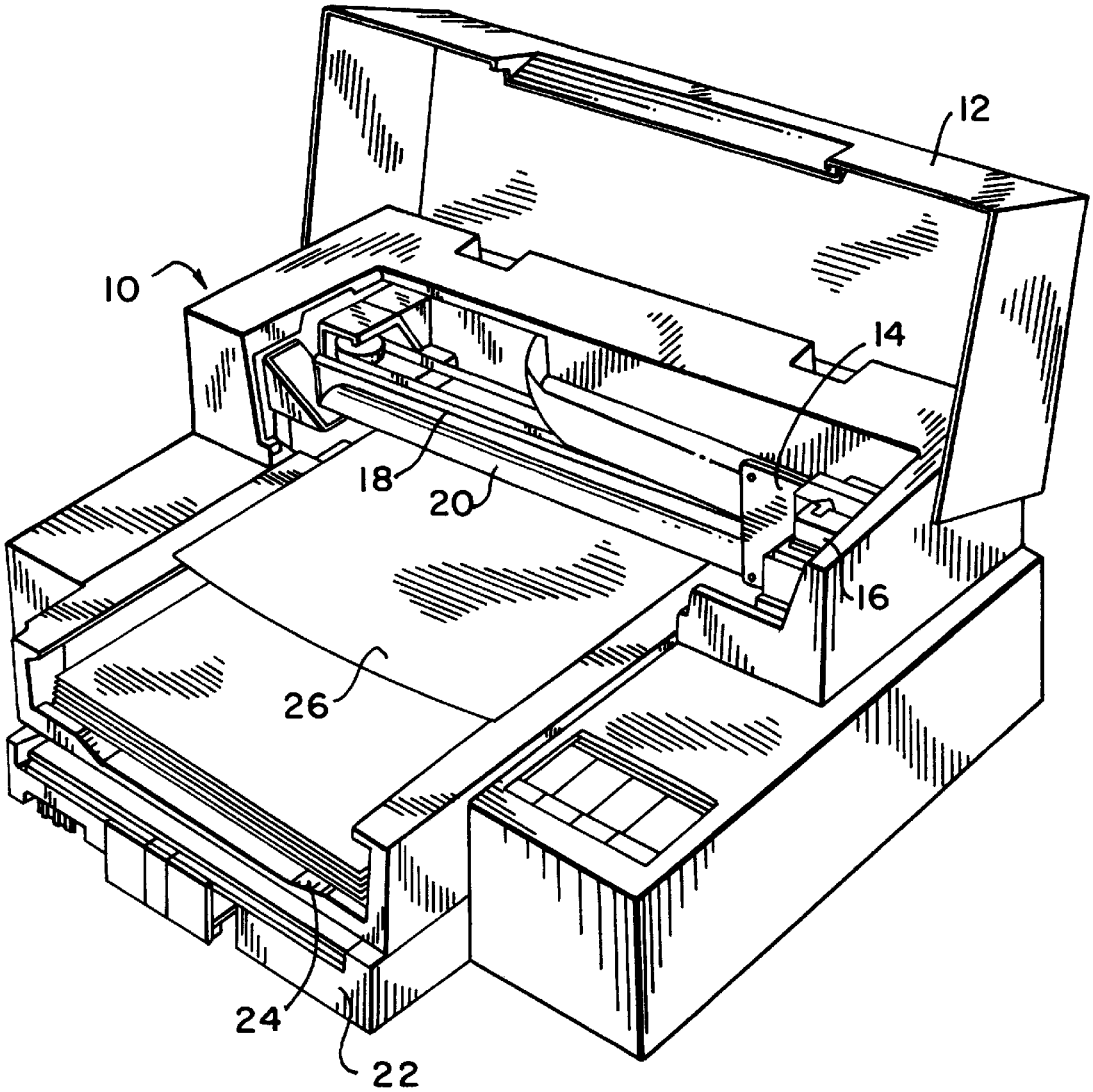
FIG. 1 is a perspective view of an ink-jet printer incorporating the present invention (hidden in the figure) with part of the printer's cover raised and open to show the printhead cartridge.
Figure 2:
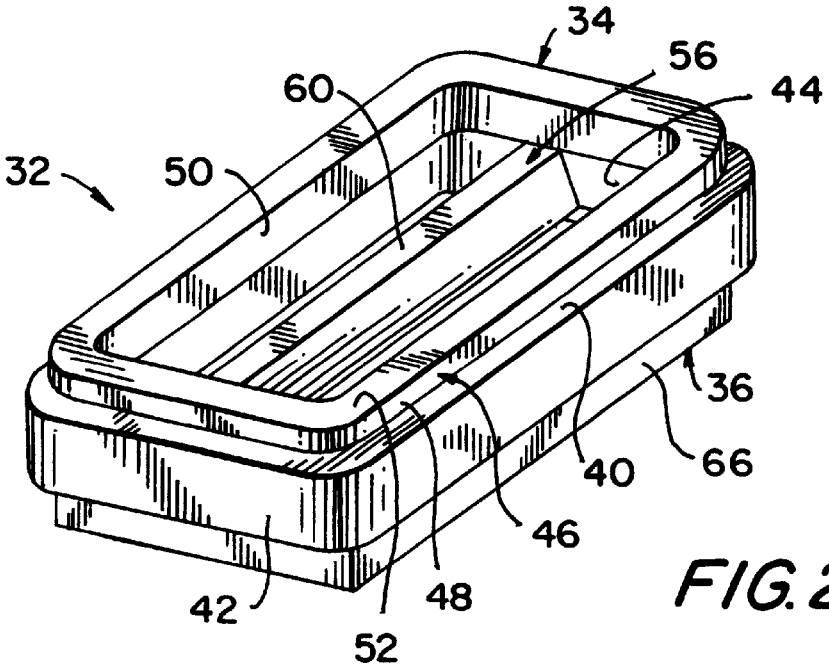
FIG. 2 is a perspective view of a printhead protection cap according to the present invention.

FIG. 1 shows a typical ink-jet printer 10 with its lid 12 open and raised so that a printhead carriage 14 and printhead cartridge 16 are visible. Cartridge 16 is mounted on carriage 14 and they both move back and forth on rod 18 and guard 20. In FIG. 1, carriage 14 and cartridge 16 are shown at the extreme right end of rod 18, in the location of the service station. Cartridge 16 is moved to the service station when the printer is not printing or when it needs servicing. On other printers, the service station may be located at the left end of rod 18.

Printer 10 also includes an input paper tray 22 and an output paper tray 24. Paper enters the printer from tray 22, moves through the printer, and exits into tray 24. As the paper exists into tray 24, cartridge 16 moves back and forth across the sheet and discharges drops of ink, resulting in a printed image. In FIG. 1, a sheet of paper 26 is shown exiting the printer after printing.

Figure 4:
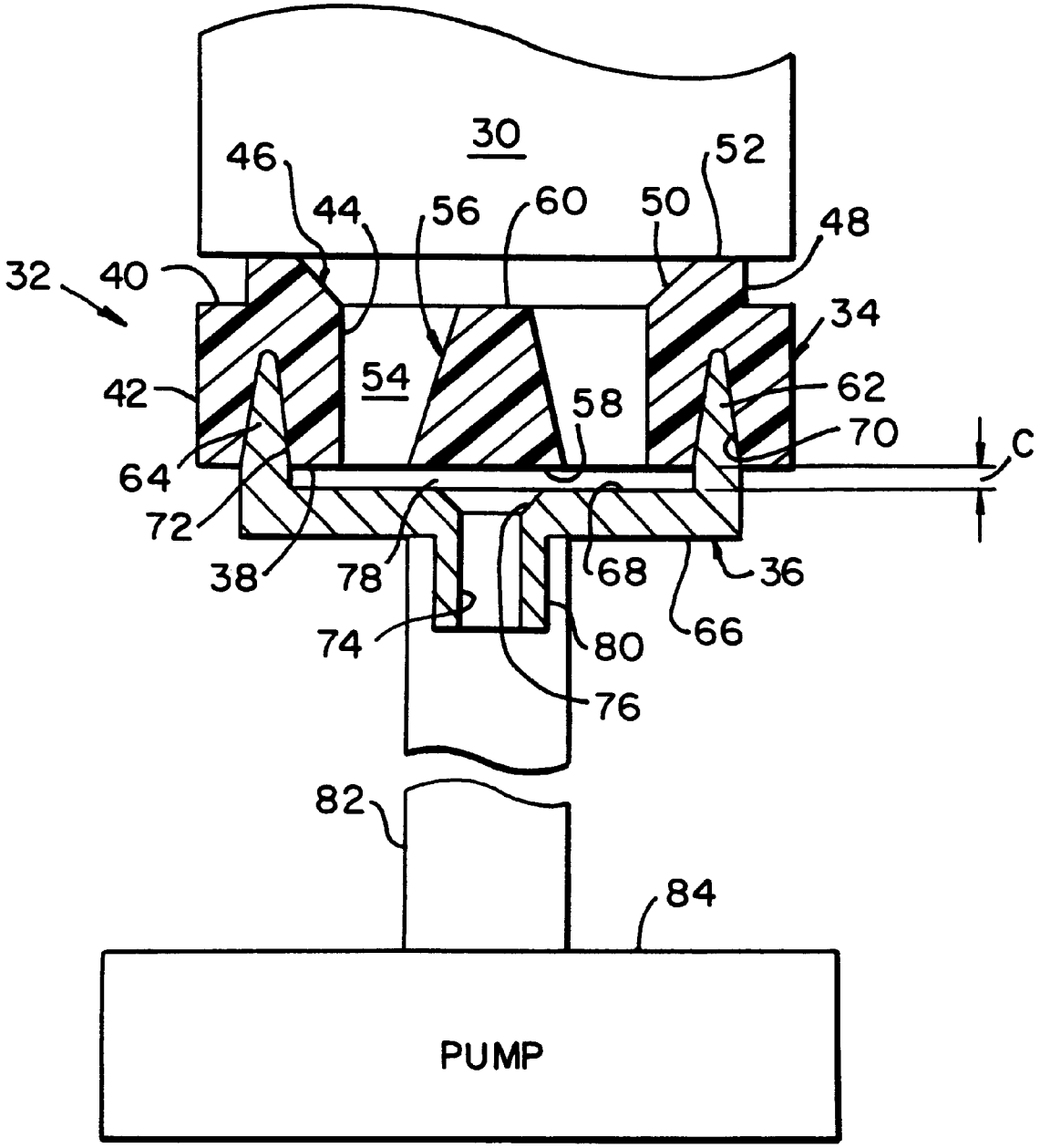
FIG. 4 is a cross-section taken through the line 4—4 of the cap shown in FIG. 3 in its assembled state in an ink-jet printer.
Figure 5:
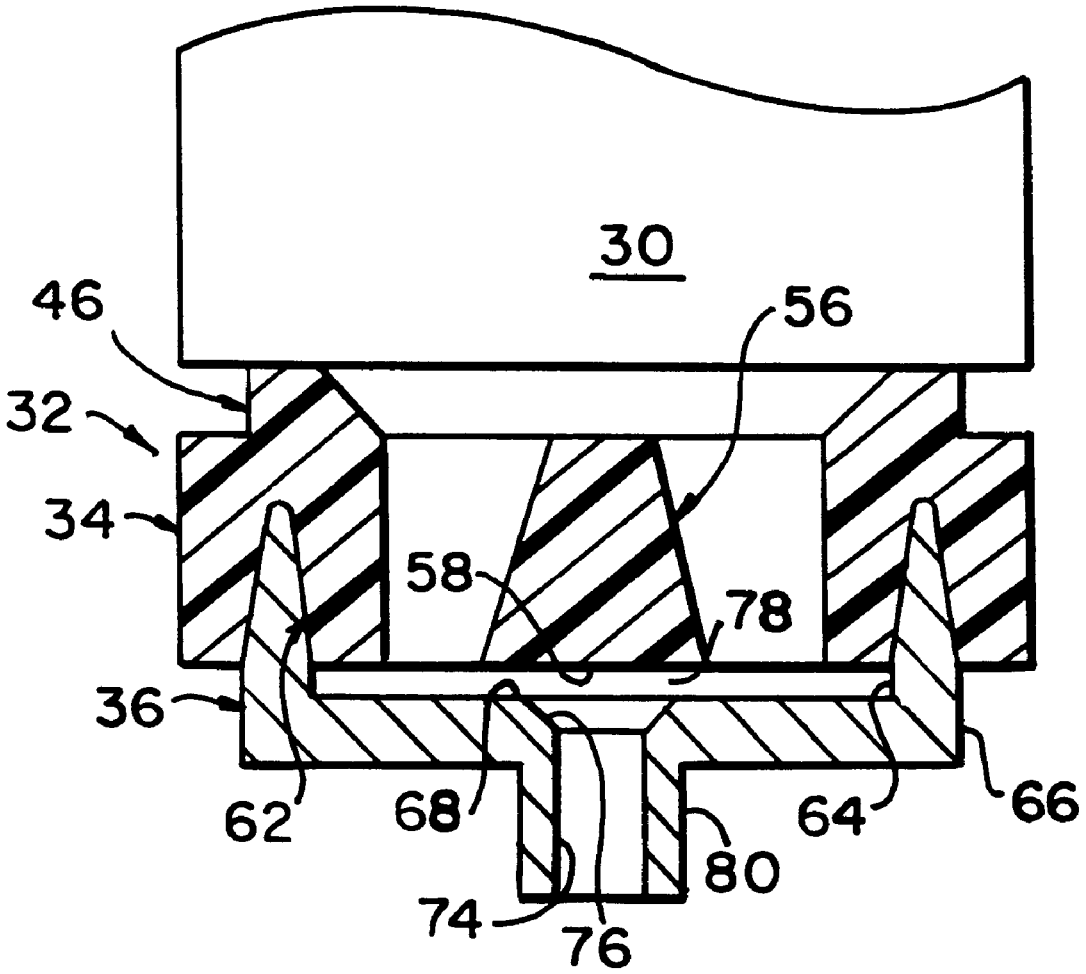
FIG. 5 is a fragmentary view of FIG. 4 illustrating the cap with an ink film formed in the capillary spaces formed between walls associated with a cavity defined by the cap.

Cartridge 16 includes an ink reservoir (not shown) and a printhead 30 (see FIG. 4). As is known in the art, printhead 30 includes nozzles (not shown) through which ink is discharged from the reservoir onto the paper.

In FIG. 4, printhead 30 is shown enclosed by a protective cap 32 that defines a cavity around the printhead. The cavity is kept moist by drops of ink that have been discharged or drooled into the cavity from the printhead. Ink may be discharged from the printhead into the cavity to clear the nozzles from any plugs of ink or simply to keep the cavity moist. The moisture in the cavity helps prevent ink from drying on the printhead or clogging the nozzles.

Cap 32 is illustrated in detail in FIGS. 2 through 5. Cap 32 in its preferred embodiment includes a cap body 34 and a basin structure 36. As discussion proceeds, it will be appreciated that cap body 34 and basin structure 36 cooperate with each other to define the cavity around printhead 30 (see FIG. 4). The cap body 34 includes a base and top walls 38 and 40 that are spaced but interconnected by outer and inner peripheral walls 42 and 44. The cap body 34 also includes a lip region 46 protruding from the top wall 40. Lip region 46 extends around the periphery of the cap body. As may be seen in FIGS. 3 and 4, lip region 46 is preferably peripherally coextensive with the top wall 38. Lip region 46 may be seen in FIG. 4 to include a vertical surface 48 and an outwardly inclined surface 50 that terminate at a top surface 52 that is dimensioned to provide an impact point for the generally planar ink-jet's printhead, to thereby sealingly engage the printhead, as shown.

Figure 3:
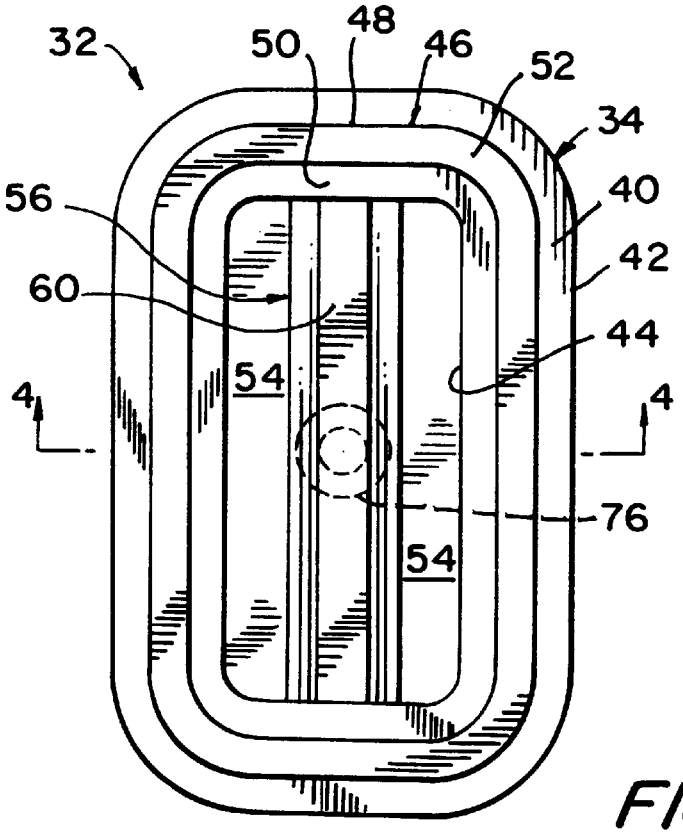
FIG. 3 is a top plan view of the cap shown in FIG. 2.

Cap body 34 may be seen by reference to FIGS. 1 and 3 to be annular. Thus, the inner peripheral wall 44 defines a hole 54 centrally located in the cap body. Cap body 34 also includes a beam 56 extending across hole 54. Beam 56 may be seen by reference to FIG. 4 to taper in cross section upwardly and inwardly to what may be described as a generally trapezoidal configuration. Preferably, beam 56 extends from one portion of inner peripheral wall 44 to the remotest opposite portion thereof, and has a base flat surface 58 that bridges base wall 38 and a top surface 60 that bridges top wall 40. Preferably, base flat surface 58 extends coplanar with base flat wall 38.

As best seen in FIG. 4, cap body 34 has a peripheral channel 62 dimensioned to receive an upwardly extending annular boss region or cap mount 64 of the basin structure 36 partly therein. By reference to FIG. 4, channel 62 in cross section may be seen to have an upwardly and inwardly inclined exterior sidewall 70 and an upwardly and outwardly inclined interior sidewall 72. Inclined exterior and interior sidewalls 70 and 72 extend upwardly to a point in a generally triangular cross-sectional profile of channel 62. Cap mount 64 extends along the periphery of a relatively stiff frame member 66 of basin structure 36. Frame member 66 mounts cap mount 64 on its upper planar flat wall 68. Frame member 66 has a vent hole 74 extending downwardly, as viewed in FIG. 4, from a vent port 76 disposed within upper planar flat wall 68. Vent hole 74 is centrally located and opposed to base surface 58 of the beam 56. Cap mount 64 tapers in cross section upwardly and inwardly substantially to a point in a generally triangular cross-sectional configuration. Channel 62 and cam mount 64 are dimensioned such that a predetermined clearance C is provided between base wall 38 of cap body 34 and upper planar flat wall 68 of frame member 66. Thus, a capillary space 78 is defined between base surface 58 of beam 56 and upper planar flat wall 68 of the frame 66. Capillary space 78 extends completely along the periphery of vent port 76 so that the vent port communicates via the capillary space with hole 54. To facilitate the capillary action, cap body 34 is constructed of a wetting material such as natural rubber or synthetic rubber. Vent hole 74 extends through a downwardly protruding boss 80. As seen in FIG. 4, vent hole 74 is connected via a tube 82 to a suction pump 84.

If printhead 30 needs servicing, cap 32 is moved against the printhead. When cap 32 is moved against printhead 30, cap body 34 engages, to form a compression fit along lip region 46 with, printhead 30. This seals the cavity that is defined by the working surface of printhead 30, lip region 46, inner peripheral wall 44 of cap body 34, and the upper planar flat wall 68 of frame 66. When pump 84 is put into operation, dried ink particles and bubbles are drawn from the nozzles of printhead 30 into the inside of the cavity defined by cap 32. The ink particles collected in the inside of cap body 34 are drawn into tube 82 through capillary space 78 and the vent hole 74 toward suction pump 84. The ink particles are discharged into a reservoir, not shown, after leaving pump 84.

Owing to capillary action, a portion of the ink particles remains in the capillary space 78 to form an ink film, providing an effective seal between port 76 of vent hole 74 and the cavity defined by cap 32. This prevents the nozzles of printhead 30 from communicating with the ambient environment. Provision of the ink film in capillary space 78 not only seals the cavity defined by cap 32, but also keeps the cavity and the nozzles of printhead 30 humid.

In the preferred embodiment, the present invention is embodied in a cap of the so-called temporary capping type wherein, when an ink-jet printhead needs servicing, an cap is moved against the printhead. The present invention may equally be embodied in a cap of the so-called permanent capping type.

What is claimed is:

1. An ink-jet printer comprising:

a printhead; and a cap adapted to contact said printhead and having a shape that defines a cavity around said printhead when in contact therewith, said cap including:

a cap body formed with a lip region and a beam extending across said cavity, and a basin structure formed with a vent for providing an exit passage from said cavity through a vent port, said vent port being opposed to said beam, and wherein said cap body and said basin structure cooperate to define a capillary space by which a seal between said cavity and said vent is formed when ink particles are present in said capillary space.

2. An ink-jet printer as claimed in claim 1, wherein said cap body has a bottom planar surface and said basin structure has an upper planar surface, wherein said bottom planar surface and said upper planar surface are spaced to provide a clearance wide enough to define said capillary space.

3. An ink-jet printer as claimed in claim 2, wherein said basin structure includes a frame member and a cap mount, and said cap body is formed with a peripheral channel partly receiving said cap mount.

4. A cap for an ink-jet printhead, comprising:

a cap body; and a basin structure having mounted thereon said cap body, said cap body and said basin structure cooperating with each other and shaped to define a cavity around the printhead when said cap is in contact with the printhead, said cap body including a beam which bridges said cavity, said basin structure including a frame member and a vent port within said frame member and opposing said beam, and said cap body and said frame member defining therebetween a capillary space around said vent port to create a seal between said vent port and said cavity when ink particles are present in said capillary space.

5. A cap as claimed in claim 4, wherein said cap body includes spaced first and second end walls and spaced outer and inner peripheral walls that are interconnected by said spaced first and second end walls, a lip region on said first end wall, and said beam bridges two portions of said inner peripheral wall, and wherein said frame member and said beam have opposed spaced walls defining therebetween said capillary space.

6. A cap as claimed in claim 5, wherein said basin structure includes a cap mount on said frame member, and wherein said cap body includes a peripheral channel dimensioned to partly receive said cap mount.

* * * * *